US005479151A

United States Patent [19]

Lavelle et al.

[11] Patent Number: 5,479,151

[45] Date of Patent: Dec. 26, 1995

[54] ELECTROMAGNETIC DOOR LOCK WITH ON-BOARD PROGRAMMABLE ACCESS CONTROL

[75] Inventors: Gary E. Lavelle, Avon; Peter S. Conklin, Simsbury, both of Conn.

[73] Assignee: Harrow Products, Inc., Grand Rapids, Mich.

[21] Appl. No.: 220,787

[22] Filed: Mar. 31, 1994

[51] Int. Cl.[6] ..... G08B 13/06; G08B 13/08

[52] U.S. Cl. ..... 340/542; 292/251.5; 340/543; 340/545; 361/161; 361/171

[58] Field of Search ..... 340/542, 543, 340/545; 361/160, 171; 292/251.5

[56] References Cited

U.S. PATENT DOCUMENTS

| | | | |
|---|---|---|---|
| 4,755,799 | 7/1988 | Romano | 340/542 |
| 4,831,374 | 5/1989 | Masel | 340/542 |
| 5,065,136 | 11/1991 | Frolov et al. | 340/545 |
| 5,153,561 | 10/1992 | Johnson | 340/543 |
| 5,289,534 | 2/1994 | Lester et al. | 340/545 |

*Primary Examiner*—Glen Swann

[57] ABSTRACT

An electromagnetic door lock system employs an on-board microprocessor which is mounted in the housing for the electromagnet. The microprocessor is pre-programmed with possible operating parameters which are then selected at the installation site. In one embodiment, a contact activatable data reader is mounted at the housing to provide various input data for the microprocessor. The microprocessor is also capable of being interrogated to reveal the preset operating parameters and other information, including the identification of individuals requesting to egress through the associated doorway.

25 Claims, 7 Drawing Sheets

ELECTROMAGNETIC DOOR LOCK WITH ON-BOARD PROGRAMMABLE ACCESS CONTROL

BACKGROUND OF THE INVENTION

This invention relates generally to electromagnetic locks which are employed in connection with doors for controlling egress and/or access through the door. More particularly, the present invention relates to electromagnetic lock systems which employ an electromagnetic core mounted in a housing and an armature mounted relative to the door and the door frame to automatically control passage through the door.

Electromagnetic locks have been employed for a number of exit door/emergency door applications to provide an effective and reliable means for locking the associated door while also permitting egress through the door in an emergency and other situations. The functions and capabilities of such electromagnetic lock systems have become relatively sophisticated. For example, common features incorporated in conventional electromagnetic lock systems include a time delay to delay unlocking of the lock for a pre-established time interval to enhance security and control egress from the secured enclosure. Various alarms, visible signal devices and monitors also are employed for activation when an attempt is made to egress through the associated exit or emergency door. Electromagnetic lock systems also commonly incorporate devices releasing the electromagnetic lock in case of fire. Conventional electromagnetic lock systems may also automatically generate various signals and instructions at the electromagnetic lock housing for facilitating the use of the electromagnetic lock.

In U.S. Pat. No. 5,065,136, to which the present invention relates, an exit door security system employs an electromagnet and an armature to lock an exit door. A housing for the electromagnet is pivotally mounted to a frame assembly which is in turn mounted to the door frame. An attempt to exit the door causes the housing to pivot to thereby actuate a switch. The lock condition provided by the electromagnet is automatically released after a pre-established time delay. An alarm at the door can also be actuated by the switch. The electronic circuitry may be configured to allow for immediate authorized egress and to implement an immediate safety release for the lock. The lock can be operated in the normally locked or normally unlocked mode. Various alarms and visual indicators and a speech or a voice synthesizer are also incorporated into the electromagnetic lock system. The electromagnetic lock is capable of adjustment to implement time intervals for a nuisance delay, a relock delay, and an egress delay and is capable of operation in response to a number of inputs to the system.

SUMMARY OF THE INVENTION

Briefly stated, the invention in a preferred form, is an electromagnetic lock system which employs an electromagnet including a core and a coil positioned about the core which is selectively energizable for generating electromagnetic field. The electromagnet is housed by a housing. An on-board microprocessor is disposed in the housing. The coil is energized in response to the output from the microprocessor. A memory may also be positioned within the housing for communication with the microprocessor. The microprocessor defines a plurality of possible operating parameters which are specifically selected for a given application. The operating parameters are selected in response to an input signal such as may be generated by a ROM chip, an integrated circuit containing a digital code or other means.

The microprocessor may include a relock delay function for implementing a selected delay time interval prior to re-energizing the electromagnet. The microprocessor may also include a nuisance delay function for implementing a time delay interval to allow release of the electromagnetic only after a pre-established nuisance time interval. The microprocessor may also have a delay egress time function for implementing a selected period for delay egress.

In addition, the microprocessor provides a signal indicative of a false actuating event which does not extend in time equal to the nuisance time interval, an unlock alarm for actuating an alarm when the electromagnetic lock is de-energized or unlocked, and a door propped-open alarm for actuating an alarm indicative that a door is in a propped open state. The microprocessor also preferably includes a passcode validation function for establishing valid electronic passcodes to allow legal passage through the associated doorway. An audit means also communicates with the microprocessor for recording information concerning requests for egress and valid egresses through the associated doorway. The microprocessor also includes an interrogator function which provides information relating to the various selected operating parameters.

In a preferred embodiment, a contact activatable data port is mounted to the housing for communicating with a contact activatable ROM chip. A remote electronic input may also provide input signals to the microprocessor.

An object of the invention is to provide a new and improved electromagnetic lock having on-board programmable access control.

Another object of the invention is to provide a new and improved electromagnetic door lock which may be programmed in the field for a given installation.

A further object of the invention is to provide a new and improved electromagnetic door lock which is capable of recording and monitoring the access and egress through the associated door.

A further object of the invention is to provide a new and improved electromagnetic lock system having a microprocessor which is mounted in the electromagnet housing for controlling the access through the associated door.

Other objects and advantages of the invention will become apparent from the drawings and the specification.

DETAILED DESCRIPTION OF THE PREFERRED EMBODIMENT

Figure 1:
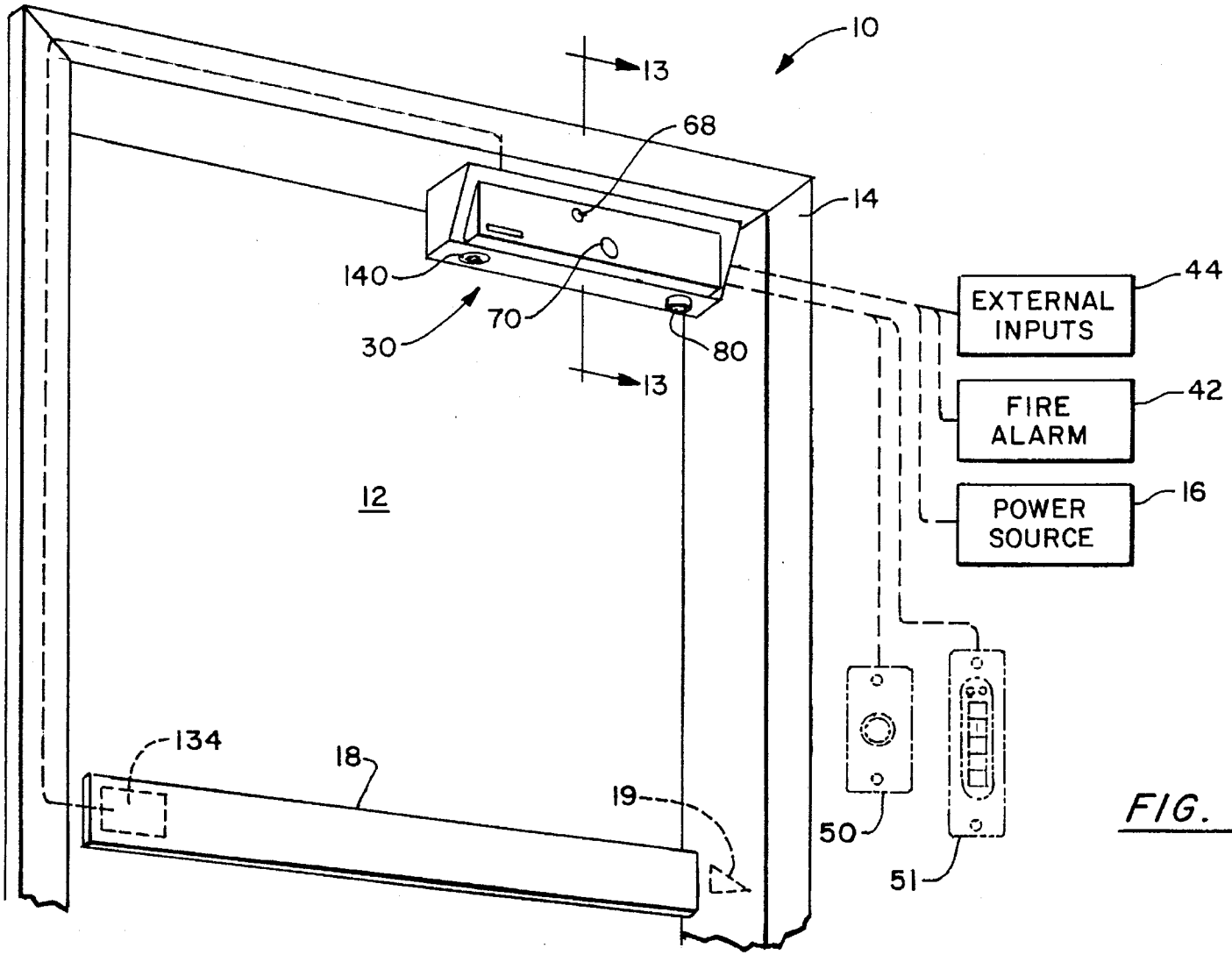
FIG. 1 is an elevational view, partly in schematic, of an electromagnetic door lock system in accordance with the invention, illustrated in conjunction with a door frame and an exit door.

With reference to the drawings wherein like numerals represent like parts throughout the figures, an electromagnetic door lock system, in accordance with the present invention, is generally designated by the numeral 10. In the preferred application, door lock system 10 is positioned in connection with an exit door 12 and a door frame 14 for controlling egress through the exit door (from the front side of FIG. 1) and for selectively automatically locking the exit door by electromagnetic bonding to control access from the exit side of the door (the rear side of FIG. 1). The electromagnetic lock security system 10 has a wide range of applications and features and is not limited to the application as illustrated in connection with the exit door 12.

The door system 10 comprises an electromagnet module 20 which preferably mounts at the upper side portion of door frame 14 and an armature assembly 30 which preferably mounts to the door. The electromagnet module includes an on-board microprocessor 22 (FIG. 12) to provide for programmable access control and other features as will be detailed below. As used herein, "microprocessor" encompasses a microcontroller and a microcomputer. The electromagnet assembly 20 generates a magnetic field which bonds with the armature assembly 30 (FIG. 13) to lock the door with the door frame, as will be detailed below. In preferred form, the electromagnet assembly comprises the bracket frame 24 which receives and pivotally mounts a generally rectangular housing 60. The housing mounts the electromagnet 28, the microprocessor 22 and various other controls and components as will be detailed below.

The electromagnetic lock system 10 communicates with the power source 16 and other external sources via wires or a cable which extends in the door frame. The door lock system is preferably employed in connection with the panic bar or push bar 18 which releases a door latch 19 or with any other conventional latching mechanism of the door. Alternately, the door lock system may be employed without any latching device.

The housing 26 has a substantially rectangular configuration which is pivotally mounted within the bracket frame 24. The housing and the bracket frame are dimensioned to permit limited pivotal or rocking displacement of the housing so as to actuate a switch 32. The switch 32 triggers automatic operation of the electromagnetic lock in response to a reaction force exerted against the secured side of the exit door, as described in U.S. Pat. No. 5,065,136, the disclosure of which is incorporated herein by reference. The switch 32, which is mounted in the electromagnetic lock assembly, is actuated upon certain pivotal or rocking motion of the electromagnetic lock assembly. Upon attempting to open the door, the switch generates a signal which is employed in connection with a time delay release of the electromagnetic lock and/or an alarm to alert that an attempt is being made so that egress may be monitored. In some embodiments, the pivoted housing and rocking switch features are not employed.

Figure 13:
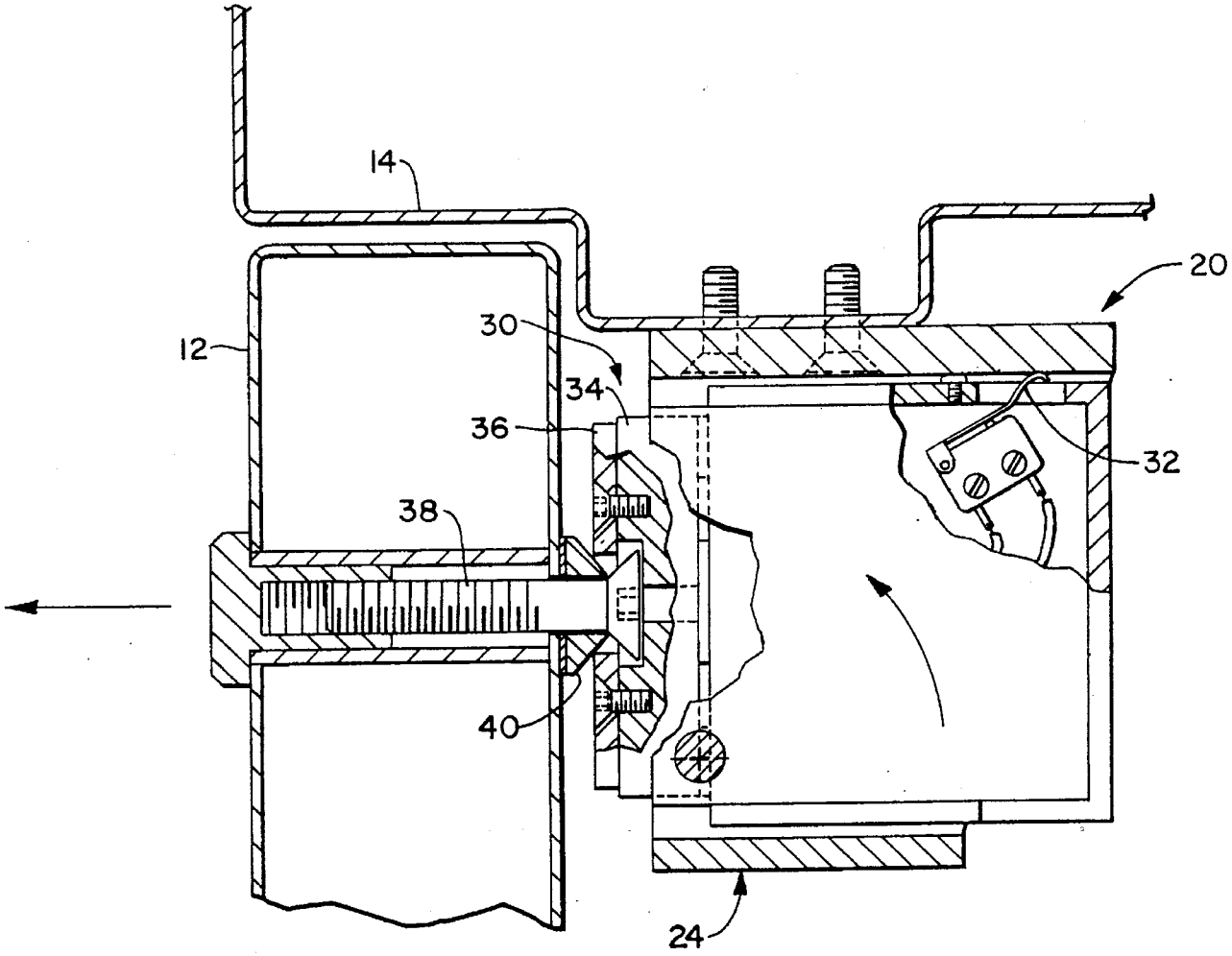
FIG. 13 is an enlarged fragmentary sectional view of the system of FIG. 1, taken along the line 13—13 thereof.

With reference to FIG. 13, the armature assembly 30, which may be similar to the armature assembly disclosed in U.S. Pat. No. 4,957,316, employs an armature plate 34 and a back plate 36. A fastener 38 has a head received in a recess in armature plate 34 and an aperature of plate 36. The shank of the fastener is anchored by a nut which is received by the sleeve of the door. A space or collar 40 is interposed between the door and the head of the fastener. The fastener 38 is configured so that it cannot over-tighten and also allows for limited pivotal movement of the armature plate above the fastener.

The exit door 12 may be latched to the door frame by latch 19 which is responsive to the panic bar 18. A mortise lock (not illustrated) or any other device which employs a mechanical lock may also be employed with the door lock system 10. In a preferred application, the system 10 incorporates a contact activatable data port or reader 50 or a keypad 51 or a card reader (not illustrated) at the exit side of the door to control access therethrough. A suitable reader 50 is the Touch Entry™ reader which employs a ROM microchip having a personal identification number and which is marketed by Locknetics Security Engineering of Forestville, Conn. A suitable keypad 51 is the Smart Entry™ Series 770, 771, 772, 773 or 774 keypad marketed by Locknetics Security Engineering.

Power from the power source energises the electromagnet to magnetically bond with the armature to maintain the door in a locked state. In case of smoke, fire or other emergency, an alarm 42 activates and overrides all other inputs and interrupts power to the electromagnet to release the electromagnetic bonding to thereby instantaneously unlock the door. Egress through the door is permitted by releasing the latch in a conventional fashion. The lock may be released by other remote external inputs, such as a release from a security console.

Figure 4:
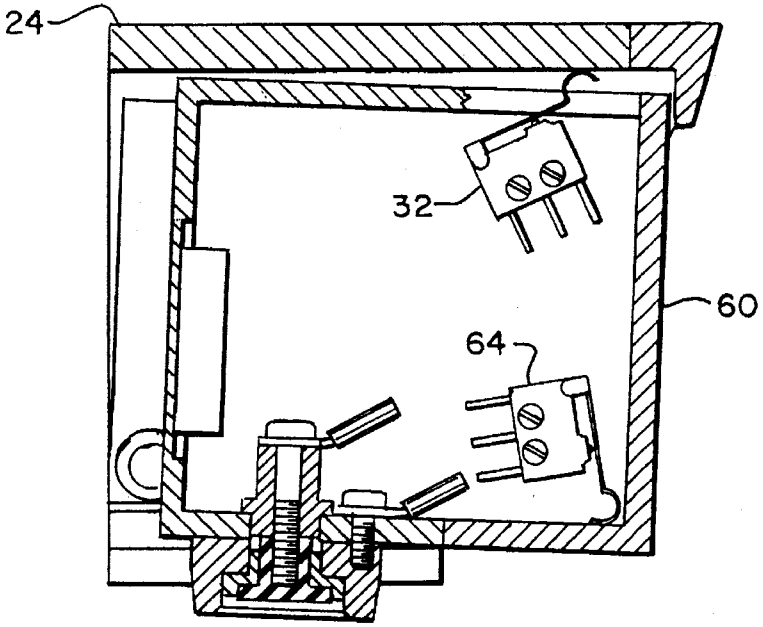
FIG. 4 is a sectional view of the housing of FIG. 2, portions removed, taken along the line 4—4 of FIG. 2.

A rear cover 60 is secured to the housing body by screws. The cover may be easily removed to provide access to a circuit board mounted control module 62 which is disposed rearwardly of the electromagnet. Integrity of the on-board circuitry is enhanced by an anti-tamper switch (ATS) 64 (FIG. 4) which indicates that the cover 60 has been removed. The control module includes the microprocessor 22 and a non-volatile memory 66 which communicates with the microprocessor. The erasable non-volatile memory 66 contains access code data and data which electronically defines the product model; i.e., the applicable options and features. The control module also includes circuitry which connects with the rocking switch 32 and an exteriorly visible status light 68 and a warning horn 70. The status light 68 is a tri-color LED. The LED 68 pulses red flashes upon transmittal of a delay request. The LED 68 continuously pulses yellow flashes throughout the delay time interval. The LED 68 is green when the electromagnet 28 is de-energized and the door is unlocked.

A ROM microchip reader 80 is mounted at the underside of the housing. The reader 80 communicates with the microprocessor 22 and may be employed to provide an electronic input to the microprocessor to, for example, reset the lock after egress, cancel a signal which has been activated, and/or to program the microprocessor as to which valid pass codes will be accepted to provide access to the secured area via the reader 50 or to retrieve an audit history, as described below. For example, security personnel may have a master ROM chip with a master identification code. The master chip is contacted against the reader to reset the lock after an emergency egress.

Figure 5:
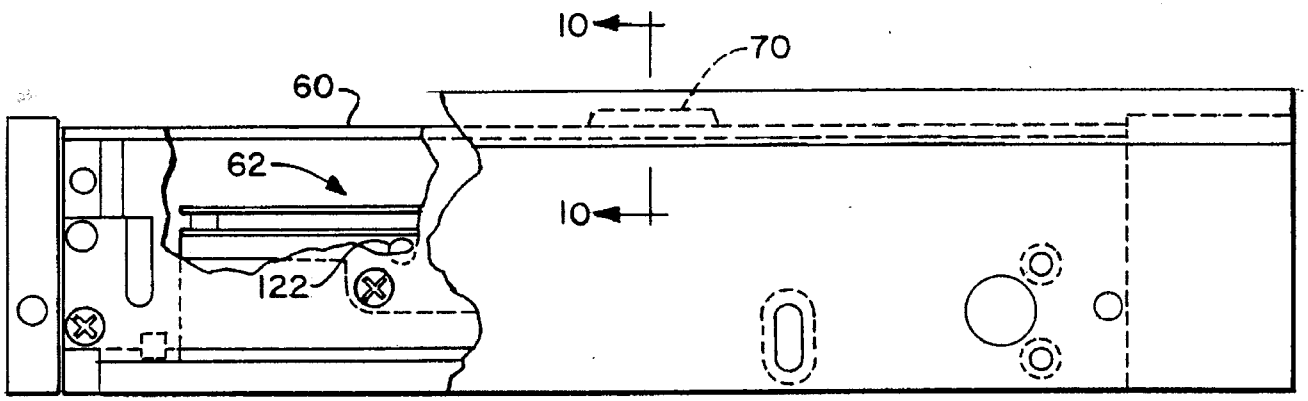
FIG. 5 is a top view, partly broken away and partly in phantom, of the electromagnet housing of FIG. 2.
Figure 6:
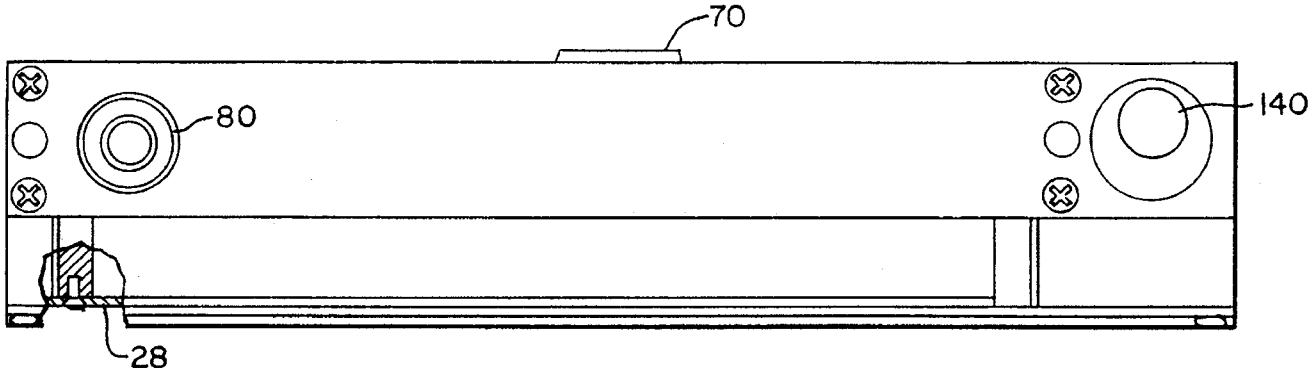
FIG. 6 is a bottom view, partly broken away, of the electomagnet housing of FIG. 2.
Figure 8:
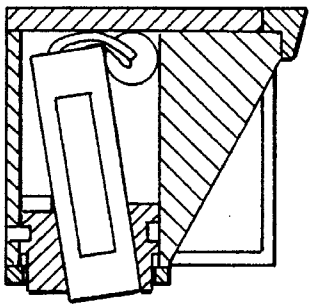
FIG. 8 is a sectional view, partly broken away with portions removed, of the electromagnetic lock of FIG. 2 taken along the line 8—8 thereof.
Figure 7:
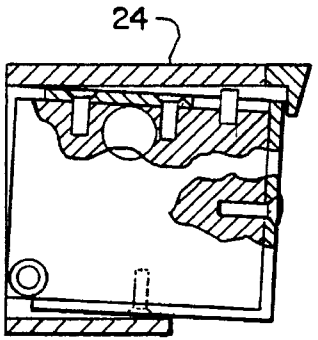
FIG. 7 is a sectional view, partly broken away and partly in phanton, of the electromagnet housing of FIG. 2, taken along the line 7—7 thereof.
Figure 10:
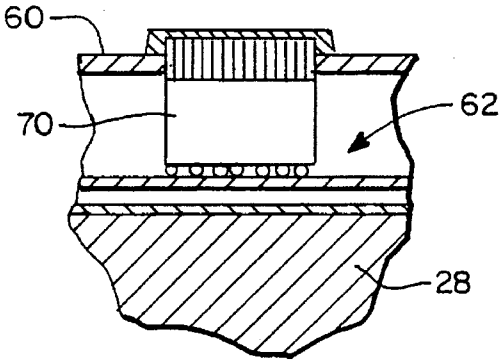
FIG. 10 is an enlarged sectional view of the electromagnet housing of FIG. 5, taken along the line 10— 10 thereof.
Figure 9:
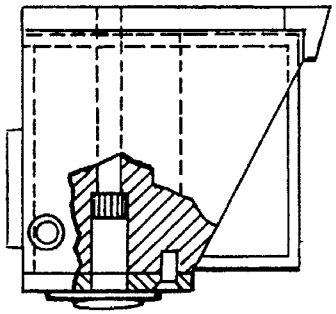
FIG. 9 is an end view, partly broken away and partly in phantom, of the electromagnetic lock of FIG. 2, viewed from the right thereof.
Figure 11:
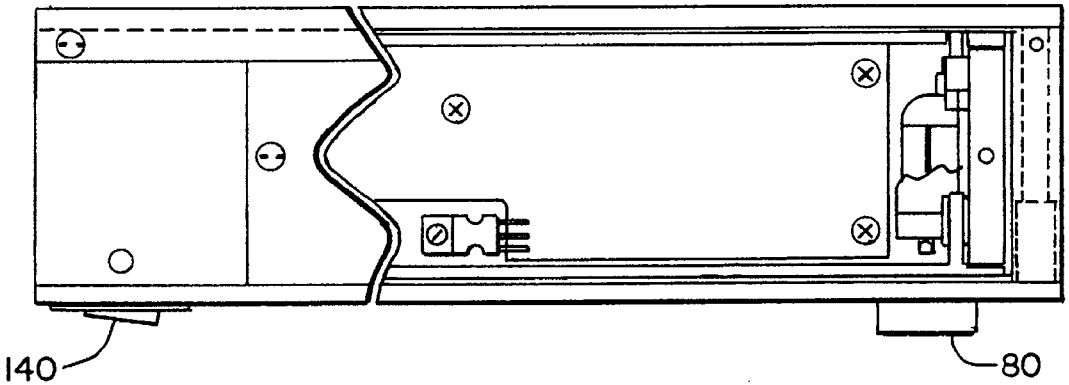
FIG. 11 is a rear interior view, partly broken away with portions removed, of the electromagnet housing of FIG. 2.
Figure 12:
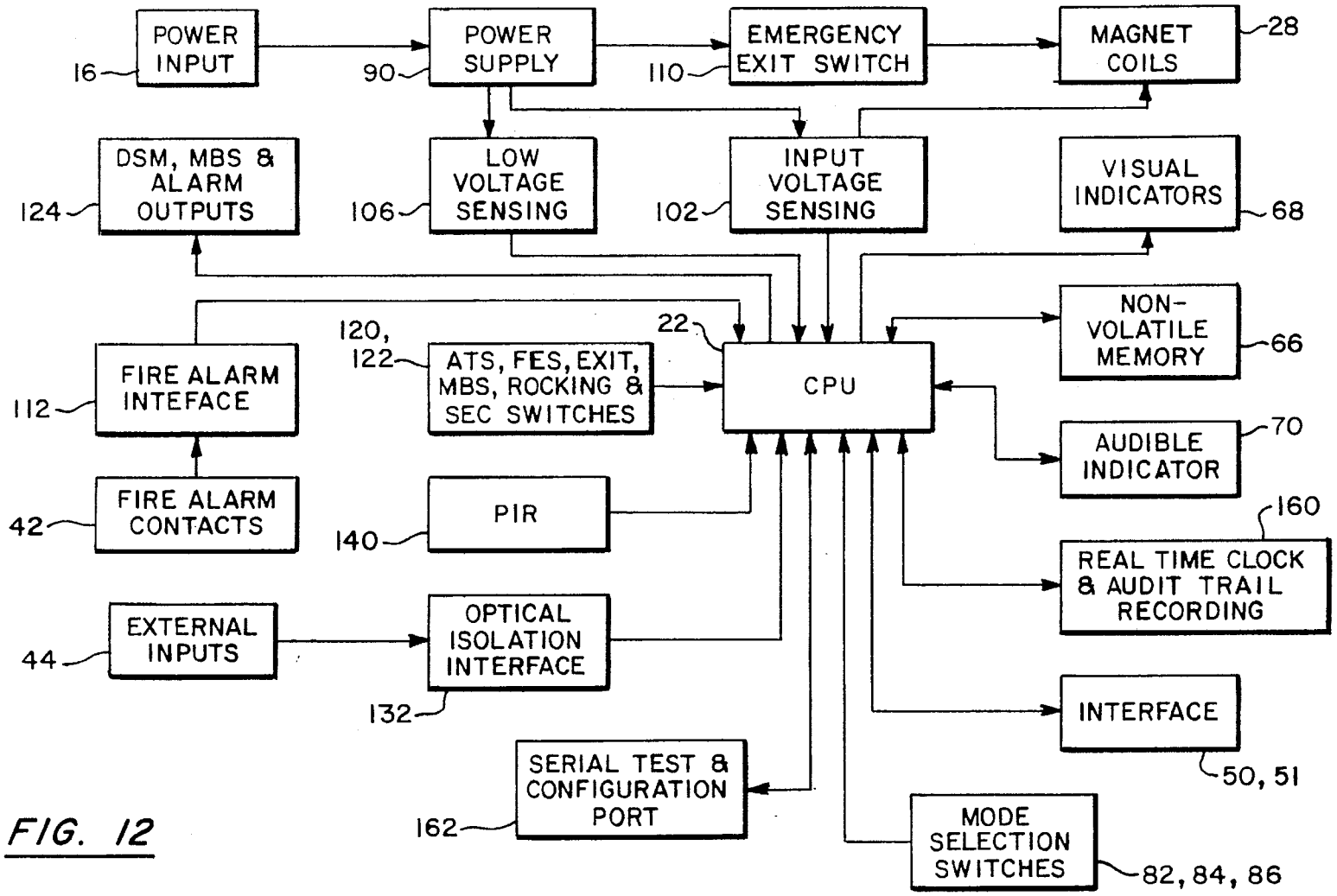
FIG. 12 is a simplified schematic block diagram of the door access control system for the lock system of FIG. 1.

Programming for the on-board microprocessor 22 is at least partially accomplished via a mode selection switch 82 and switches 84 and 86 of the control module 62 (FIG. 5). The switches are accessed by removing the back cover. The switches may be manually activated to provide inputs to the microprocessor for encoding the various features. The programming may be accomplished at the installation site. The on-board microprocessor provides a multi-function and multi-option capability as is illustrated in the diagrams of FIG. 12, as well as certain programmable site-specific features as will be detailed below.

The power supply 90 which may have a plug-in or a box-mounted configuration includes a transient suppression circuit, a bridge rectifier and a filter. The filtered power is passed across a fire alarm relay switch to the magnetic power control circuit. The power output from the control circuit is applied to the electromagnet 28 via an automatic selection circuit 102 which automatically selects the input power voltage, for example, 12 or 24 volts. The filtered input voltage is passed to a voltage regulator via a low voltage sensing circuit 106 and the regulated voltage is applied to the coils of the electromagnet system 28. Power to the electromagnet communicates via an illuminated emergency exit switch 110 which immediately terminates power to the electromagnet in emergency conditions.

The signal from the fire alarm 42 is applied via a fire alarm interface 112 and in conjunction with the mode select switch 82 to the microprocessor 22. The switch 82 may be manually programmed in accordance with whether the associated fire alarm 42 is configured to have a normally open or normally closed contacts. Upon transmission of a fire signal from the fire alarm 42, power is removed from the magnet to thereby immediately unlock the exit door.

Figure 2:
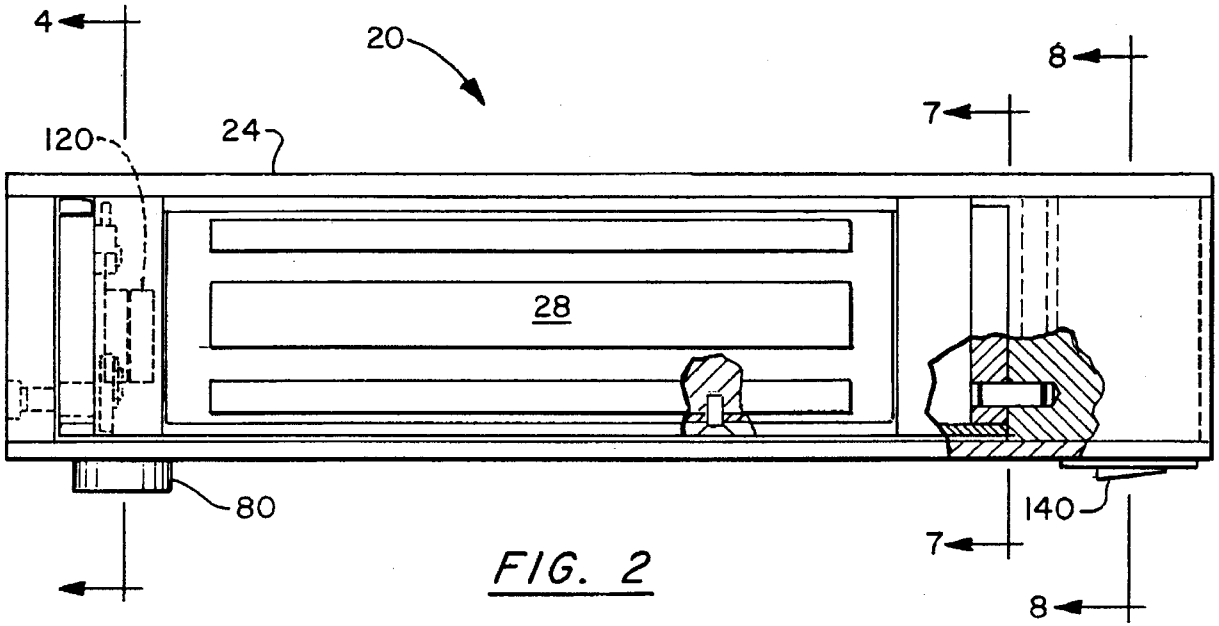
FIG. 2 is a frontal view, partly broken away and partly in phantom, of the electromagnet housing of the system of FIG. 1.
Figure 3:
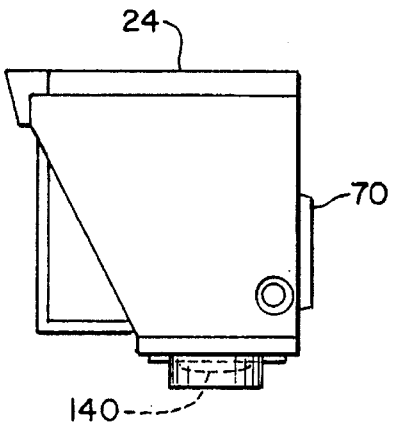
FIG. 3 is an end view of the electromagnet housing of FIG. 2, viewed from the left thereof.

A door status monitor (DSM) 120 (FIG. 2) of conventional form, such as a magnetic reed switch, is employed to generate a signal for remote monitoring. The status signal indicates whether the door is open or closed. The switch is actuated by a small magnet (not illustrated) which is concealed in an aluminum member attached at the end of the armature plate. This sealed magnet actuates the magnetic reed switch 120 which mounts at the inside of the housing.

A magnetic bond sensor (MSB) 122 which senses whether there is sufficient magnetic holding force to insure adequate locking of the exit door may also be employed. The magnetic bond sensor 122 is responsive to low-line voltage and/or foreign material in the magnetic gap between the electromagnetic and the armature and/or dirty or damaged surfaces of the electromagnet and/or the armature. Output signals from door status switch 120, magnetic bond sensor 122 and the fire alarm 42 may also be transmitted from the lock 20 to a remote console 124 to provide for remote monitoring. The switches 120 and 122 may also be employed in conjunction with CPU 22 to function as a forced entry switch (FES) and/or a security alarm switch (SEC) indicating that the door is propped open.

A legal release input signal which may be implemented by a ROM chip which is contacted against the reader 80 allows for a door to be unlocked without delay. Alternatively, an integrated circuit having a digital code or other electronically readable code device may be employed in place of a ROM chip. The legal release input immediately causes an interruption of power to the electromagnet. As the contacts are closed, the legal release input signals are present. No alarm or audio signal is generated while the legal release is present. The legal release signal is also processed and applied to a relock delay timer for initiating a relock sequence. The relock timer is programmable to set the length of time the lock is de-energized after a valid release signal, for example, the timer may be programmed for a selected time from over a period of 0 to 30 seconds for delaying the energization of the electromagnet. The relock delay interval is then stored in the non-volatile memory 66. When the legal release input signal terminates, the electromagnet is re-energized upon expiration of the delay period imposed by a relock timer. The legal release may also be generated from local devices such as the data reader 80 or a remote terminal 50 such as a remote push-button, keypad, card reader or any access control terminal at the entrance side of the exit door.

An auxiliary input signal generated by various possible external inputs 44 and indicative of an authorized exit request is applied via an optical isolator 132 to the microprocessor. The auxiliary input may originate from various sources such as a switch 134 in the panic bar and other motion or presence actuated switch may be employed as a redundant sensor signal in conjunction with switch 32. Switch 134 may operate in response to movement of the panic bar 18 or in response to a capacitance change resulting from contact with the panic bar. A request to egress may also be transmitted by a PIR sensor 140 mounted at the housing. The PIR sensor senses changes in infra-red energy and has a field of view which intersects the panic bar. The sensor thus detects an individual reaching for the panic bar.

The mode select switch 82 may be set in conjunction with switches 84 and 86 to provide an internal auxiliary function only, an external function only, an external parallel function and an exterior internal series function as described in Table II. For example, in the internal logic mode, only the switch 32 is used as a sensor input to indicate or to request access. In the exterior only mode, the switch 32 is ignored as a sensory input and the auxiliary input initiates the delay egress request as, for example, is provided by a PIR sensor 140. In the external parallel mode, either the sensory input from the switch 32 or the auxiliary input 44 will trigger delay exit requests, and therefore redundant sensory input is provided. In the external series logic mode, both the internal switch and the external contact closure which generates the auxiliary input signal are required in order to initiate the exit delay in implementation of the system. The external series logic mode has particular application in connection with the PIR sensor to distinguish between an opening force applied at exit door from the inside as opposed to from the outside of the exit door.

The microprocessor may also be programmed to implement a nuisance delay time interval. The nuisance time interval which is typically from 0 to 3 seconds is employed so that a false signal or accidental sense egress request, such as, for example, door movement due to stack pressure, does not initiate the delay egress sequence. The nuisance time interval is stored in the non-volatile memory 66.

A door propped-open delay, which defines the amount of time before alarm contacts close if the door is held open past the given time, is implemented by switches 82, 84, and 86. The propped-open delay time is then stored in the non-volatile memory 66.

A day/night reset port may be employed to provide an input to the microprocessor to change the sensor functions for time dependent securing constraints.

The output from the delay time and the output from the audible indicator 70 may be applied to a speech synthesizer. A speech synthesizers generates an output which is passed through an audio amplifier to a speaker. The audio transmission speaker may transmit a recorded message such as, for example, "AFTER A 30 SECOND DELAY, THE EXIT DOOR WILL UNLOCK" or other appropriate message In addition, the output from the alarm latch is applied to the indicator light 68. In a preferred form, the LED 68 indicator changes from a red light to a green light upon release of the electromagnetic lock. The LED flashes yellow during the nuisance delay period.

Programming for the various modes is outlined in Tables I and II set forth below.

TABLE I

| SWITCH 82 | FUNCTION |
|---|---|
| 1 | Enable Locking Switch |
| 2 | See Table II |
| 3 | See Table II |
| 4 | Enable Anti-Tailgate |
| 5 | Enable Unlocked Audible |
| 6 | Enable Door Propped-Open |
| 7 | — |
| 8 | Enable Presence Detection |

TABLE II

| SWITCH 84 | SWITCH 86 | FUNCTION |
|---|---|---|
| OFF | OFF | PIR Only |
| ON | OFF | PIR and Aux. Sensor |
| OFF | ON | PIR or Aux. Sensor |
| ON | ON | Aux. Sensor only |

Switch 82 has eight on-off positions with on-off positions 2 and 3 incorporating the four functions of Table II. The anti-tailgate function allows the electromagnet to immediately assume a locked status when the door is closed. The unlock audible function enables an audible alarm when the door is unlocked.

A reset input signal is applied via an optical isolator 132 to the microprocessor. The reset input signal functions to reset the system, e.g., to re-energize the electromagnet and terminate any alarms. Although a remote reset may be provided, due to safety regulations, it is preferable for most applications that reset be implemented through the reader which is accomplished by contacting a ROM chip at the reader port. The reset input initiates locking of the door after power outage or following an egress. The reset position will function only when the door is unlocked and will not terminate the egress delay unless the door is initially unlocked. The audio alarm 70 is also terminated by the reset signal.

The security system provided by the described electromagnetic lock microprocessor is adaptable for implementation in connection with a wide variety of exit door configurations which are programmed to account for various safety, legal egress and security constraints. The switches provide for multi-option capability which is integrated with the conventional mechanical latching hardware. The microprocessor may be programmed on-site for a given application. For example, the microprocessor may be programmed so that the door may have an exterior key lock which provides for legal or authorized access through the exit door. A keypad, card reader or other electronic entry device may be positioned at the exterior of the exit door to provide legal or authorized access to the enclosure. In addition, a sensor which may take the form of a passive infra-red presence device, a device which senses the presence of electromagnetic material or a device which is responsive to a selected radio frequency or other sensory device may be mounted to the exterior of the enclosure in the vicinity of the electromagnetic assembly. The keypad, key lock and sensor are optional features which may be programmed into the microprocessor. The power-on status may also be programmed to be either in a normally on or normally off power mode for the electromagnet when power is initially applied to the lock.

The external inputs 44 may take the form of a passive infra-red sensor which senses the presence of an individual at the door. The PER sensor provides either a redundant switch for actuating a time delay for the electromagnetic lock or a means for discriminating between a door movement (actuating switch 32) which is produced from inside of the enclosure as opposed to the outside. Ordinarily the auxiliary sensor may take the form of a switch which is activated by the presence of a magnetic or an electromagnetic object in the vicinity of the switch, such as, for example, may be present in conventional shoplifting-type security installations. The auxiliary sensor may also be responsive to a select radio frequency, such as, for example, may be generated by a transmitter or other device which is worn by patients in a convalescent home or other facility where it is desired to control access through the exit door for a selected subset of the population.

It should be appreciated that the information concerning the exit and access request may be stored in a non-volatile memory 160 to provide an audit trail which may be accessed for readout. In one preferred embodiment, the last 100 entries (time and user ID) are stored in the non-volatile memory. In addition, a serial test and configuration port 162 is provided to test the lock and to provide an output from the lock for diagnostic purposes.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An electromagnetic lock system transformable between locked and unlocked states comprising:

electromagnet means comprising a core and a coil positioned about said core and selectively energizable for generating an electromagnetic field;

armature means for attraction by said electromagnetic field;

housing means for housing said electromagnet means; and microprocessor means comprising a microprocessor disposed in said housing means and comprising input means for providing a plurality of input signals to said microprocessor and output means for generating an output signal from said microprocessor, said coil being selectively energizable in response to said output signal.

2. The electromagnetic lock system of claim 1 further comprising memory means for storing access codes and application features disposed in said housing means and communicating with said microprocessor.

3. The electromagnetic lock system of claim 1 wherein said microprocessor defines a plurality of possible operating parameters and said microprocessor selects at least one parameter in response to an input signal.

4. The electromagnetic lock system of claim 1 wherein said microprocessor comprises relock delay means for implementing a selected delay time interval for re-energizing said electromagnet means, said relock delay means defining a plurality of delay time intervals, and comprising means for selecting one of said delay time intervals in response to an input signal.

5. The electromagnetic lock system of claim 1 wherein said microprocessor further comprises nuisance delay time interval means for implementing a delay time interval to allow deenergizing said electromagnet means only after a pre-established nuisance time delay.

6. The electromagnetic lock system of claim 5 wherein said microprocessor further comprises a nuisance delay alert means for providing a signal during any such nuisance time delay.

7. The electromagnetic lock system of claim 1 wherein said microprocessor further comprises egress time delay means for implementing a selected period for egress delay, said egress time delay means defining a plurality of egress time delay periods and comprising means for selecting one of said egress time delay periods.

8. The electromagnetic lock system of claim 1 further comprising unlock alarm means for communicating with said microprocessor for actuating an alarm when said electromagnet lock means is in an unlocked state.

9. The electromagnetic lock system of claim 1 further comprising a "door propped-open" alarm means for actuating an alarm indicating that the door is in a propped-open state.

10. The electromagnetic lock system of claim 1 wherein said microprocessor means further comprises passcode means for establishing a valid electronic passcode.

11. The electromagnetic lock system of claim 1 further comprising record means for recording information concerning said input signals.

12. The electromagnetic lock system of claim 1 further comprising interrogatory means communicable with said microprocessor for interrogating said microprocessor means.

13. The electromagnetic lock system of claim 1 further comprising contact activatable data port means mounted to said housing for communicating with a contact activatable ROM chip.

14. An electromagnetic lock system for controlling passage through a doorway comprising:

electromagnet means comprising a core and a coil positioned about said core and selectively energizable for generating an electromagnetic field;

housing means for housing said electromagnet means;

microprocessor means comprising a microprocessor disposed in said housing means and comprising input means for receiving an input to said microprocessor indicative of a request to pass through the doorway, said microprocessor generating an output signal for selectively energizing said coil; and reader means disposed at said housing means for providing said input to said microprocessor means.

15. The electromagnetic lock system of claim 14 wherein said reader means comprises a contact activatable data port means mounted to said housing for communicating with a contact activatable ROM chip.

16. The electromagnetic lock system of claim 14 and further comprising a second reader means remote from said housing means for providing said to said microprocessor means.

17. The electromagnetic lock system of claim 14 wherein said microprocessor defines a plurality of operating parameters and said microprocessor selects at least one parameter in response to an input signal from said reader means.

18. The electromagnetic lock system of claim 17 wherein said microprocessor further comprises means for providing information concerning each of said selected operating parameters.

19. The electromagnetic lock system of claim 14 wherein said microprocessor comprises reset means for resetting said coil to an energized state after said coil has been de-energized in response to a request to pass through said doorway, said reset means being responsive to a signal from said reader means.

20. The electromagnetic lock system of claim 14 further comprising record means for recording information concerning said request.

21. An electromagnetic lock system for controlling passage through a doorway comprising:

electromagnet means comprising a core and a coil positioned about said core and selectively energizable for generating an electromagnetic field;

housing means for housing said electromagnet means;

microprocessor means comprising a microprocessor disposed in said housing means and comprising input means for receiving an input to said microprocessor indicative of a request to pass through the doorway, said microprocessor generating an output signal for controlling the energization of said coil, said microprocessor defining a plurality of possible operating parameters for said electromagnet means and for selecting at least one parameter, said output signal dependent on said at least one selected parameter; and signal means for providing said input to said microprocessor means.

22. The electromagnetic lock system of claim 21 wherein said operating parameters comprise a plurality of values for implementing a selected delay time interval for re-energizing said electromagnet means.

23. The electromagnetic lock system of claim 21 wherein said operating parameters comprise a plurality of nuisance time delay interval values for allowing said electromagnetic lock means to de-energize only after a pre-establish nuisance time delay interval.

24. The electromagnetic lock system of claim 21 wherein said operating parameters comprise a plurality of egress delay time values for implementing a selected delay period for deenergizing said electromagnet means in response to the request.

25. The electromagnetic lock system of claim 21 wherein said signal means comprises a contact activatable data port means mounted to said housing for communicating with a contact activatable ROM chip.

* * * * *